US007852283B2

(12) United States Patent
Eide

(10) Patent No.: US 7,852,283 B2
(45) Date of Patent: Dec. 14, 2010

(54) ROD ANTENNA DEVICE

(75) Inventor: Jo Morten Eide, Stavanger (NO)

(73) Assignee: Comrod AS (NO)

( * ) Notice: Subject to any disclaimer, the term of this patent is extended or adjusted under 35 U.S.C. 154(b) by 387 days.

(21) Appl. No.: 11/814,242

(22) PCT Filed: Jan. 19, 2006

(86) PCT No.: PCT/NO2006/000026

§ 371 (c)(1),
(2), (4) Date: Sep. 22, 2008

(87) PCT Pub. No.: WO2006/078172

PCT Pub. Date: Jul. 27, 2006

(65) Prior Publication Data

US 2009/0073068 A1 Mar. 19, 2009

(30) Foreign Application Priority Data

Jan. 20, 2005 (NO) ..... 20050318

(51) Int. Cl.
*H01Q 9/30* (2006.01)
*H01Q 1/32* (2006.01)
*H01Q 1/00* (2006.01)

(52) U.S. Cl. ..... 343/900; 343/715; 343/787

(58) Field of Classification Search ..... 343/900, 343/901, 903, 711, 715
See application file for complete search history.

(56) References Cited

U.S. PATENT DOCUMENTS 3,950,757 A * 4/1976 Blass ..... 343/791
4,028,704 A * 6/1977 Blass ..... 343/715
4,958,164 A * 9/1990 Lewis, Jr. ..... 343/749

FOREIGN PATENT DOCUMENTS

DE 866 680 C1 2/1953
EP 0 124 758 A1 11/1984
EP 1 298 796 A2 4/2003
GB 1 500 279 A 2/1978

OTHER PUBLICATIONS

International Search Report for parent PCT Application No. PCT/NO2006/000026 having a mailing date of May 5, 2006.

* cited by examiner

*Primary Examiner*—Hoang V Nguyen
(74) *Attorney, Agent, or Firm*—Andrus, Sceales, Starke & Sawall, LLP

(57) ABSTRACT

A device of a rod antenna comprising a supply transformer and first and second beam elements, wherein both beam elements are provided with a ferrite material.

6 Claims, 4 Drawing Sheets

ROD ANTENNA DEVICE

CROSS-REFERENCE TO RELATED APPLICATIONS

This application is the U.S. national stage application of International Application PCT/NO2006/000026, filed Jan. 19, 2006, which International Application was published on Jul. 27, 2006, as International Publication No. WO 2006/078172 A1 in the English language. The International Application claims priority of Norwegian Patent Application 20050318, filed Jan. 20, 2005.

BACKGROUND OF THE INVENTION

This invention relates to a rod antenna. More particularly, it concerns a rod antenna provided with a ferrite material along the longitudinal extent thereof, the ferrite material being arranged so as to define the electrical length of the rod antenna upon increasing frequency. The rod antenna is particularly well suited for use together with radio material of the kind that changes its transmission frequency relatively often.

Particularly in context of military radio communication, it is common to use radio material that keeps changing its transmission frequency during communication. The aim is to make undesired tapping of a communication circuit difficult.

Whilst the frequency range of the radio material previously could be, for example, in the range of 30 to 88 MHz, it is now common to operate within a frequency range typically being 30 to 512 MHz. To a person skilled in the art, it is obvious that radio communication across such a wide frequency range places great demands on the antenna, insofar as the antenna must be able to operate with satisfactory electrical properties, such as gain and SWR (Standing Wave Ratio), within the entire frequency range without requiring calibration of the antenna during operation.

The terms gain and SWR will be known to a skilled person and will therefore not be defined further.

In mobile communication, a rod antenna connected to, for example, a vehicle is oftentimes used, and in which the electrical length of the rod antenna may be ¼ of the wavelength. The vehicle may form the ground-plane of the antenna. The antenna in question is a so-called end-fed antenna, in which the rod antenna forms one half of a so-called "Hertzian dipole antenna".

An antenna of this kind, in which the antenna has a fixed electrical length, is relatively unsuitable for use together with radio material of the type mentioned. The reason for this is that the antenna is electrically resonant at several fixed frequencies, and that the SWR will increase to unacceptable values when the transmission frequency deviates substantially from the resonant frequency.

According to the prior art, this unfavourable condition may be overcome to a certain degree by reducing the electrical length of the antenna as the transmission frequency increases.

Thus, U.S. Pat. No. 6,429,821 discloses an end-fed rod antenna provided with induction coil resistance networks along the length thereof. In principal, these networks are arranged so as to reduce the electrical length of the antenna upon increased frequency by allowing each induction coil resistance network to disconnect, at a corresponding frequency, the part of the antenna located directly opposite the induction coil resistance network in question. Thereby, the electrical length of the rod antenna is continuously adapted to the frequency supplied. Still, the antenna exhibits a considerable variation in gain and SWR across the frequency range of interest.

SUMMARY OF THE INVENTION

The object of the invention is to remedy or reduce at least one of the disadvantages of the prior art.

The object is achieved in accordance with the invention and by means of the features disclosed in the description below and in the subsequent Claims.

It is known that, in practice, so-called centre-fed antennas, which are independent of a separate ground-plane, oftentimes form a better antenna than an antenna that is dependent on a separate ground-plane. The greatest disadvantage related to centre-fed antennas is that of the physical length of the antenna being approximately twice the length of an end-fed ground-plane-dependent rod antenna at the same frequency.

It is proven, however, that a centre-fed rod antenna comprising a supply transformer and a first and a second beam element, in which both beam elements are provided with a ferrite material, can be adapted relatively easily to a wide frequency range. The first and second beam elements project outwardly in opposite directions from the supply transformer.

The supply transformer may be a so-called Guanella 1:4 transformer.

As mentioned, the rod antenna becomes relatively long when it is to operate at relatively low frequencies. In order to overcome this problem, the supply transformer is connected to a third beam element. At the relatively low frequencies, the third beam element forms an end-fed ground-plane-dependent rod antenna.

In a practical embodiment at least one of the first and second beam elements may form a part of the third beam element.

The third beam element may be divided by means of a capacitor. The third beam element may also be provided with a ferrite material.

Advantageously, each beam element may be divided into beam element portions, in which a ferrite material is arranged between the beam element portions. Normally the ferrite material will surround the beam element and preferably is formed as a ring.

The operation of the rod antenna is described in further detail in the specific part of the description.

As compared to known antennas, it is proven that a rod antenna according to the invention exhibits very good values with respect to gain and SWR across the frequency range 30 to 512 MHz.

BRIEF DESCRIPTION OF THE DRAWINGS

A non-limiting example of a preferred embodiment is described hereinafter, the embodiment being illustrated in the accompanying drawings, in which.

DETAILED DESCRIPTION OF THE DRAWINGS

Figure 1:
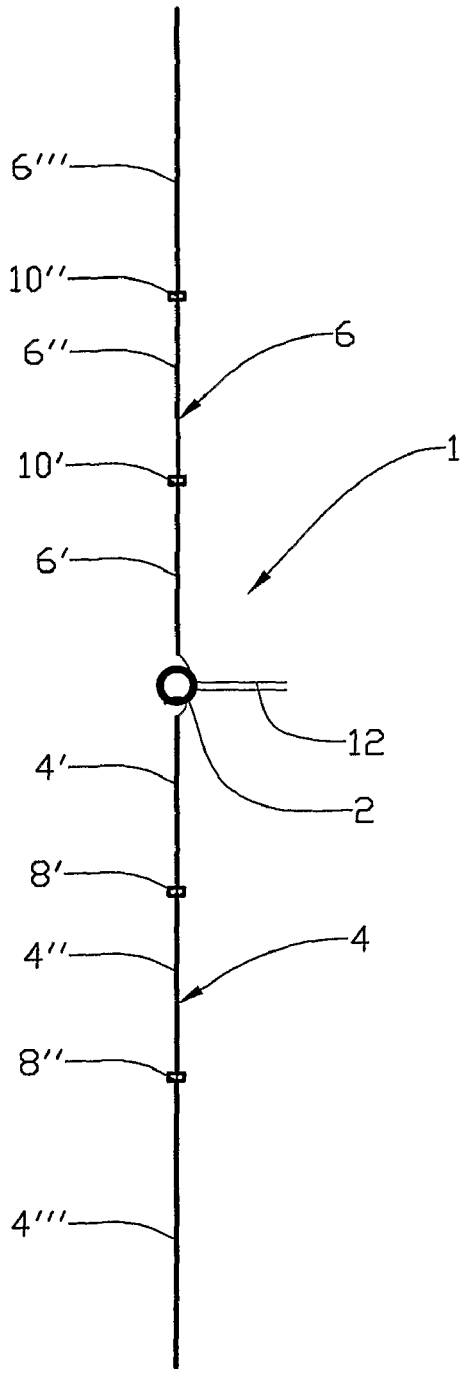
FIG. 1 schematically shows a centre-fed rod antenna.

In the drawings the reference numeral 1 denotes a centre-fed antenna, which comprises a supply transformer 2, a first beam element 4 and a second beam element 6. The beam elements 4 and 6 project outwardly in opposite directions from the supply transformer 2, and the beam elements 4 and 6 may be formed from, for example, a copper cable, a brass pipe, combinations thereof, or from similar materials, as will be known to a skilled person.

The first beam element 4 is provided with two ferrite bodies 8' and 8" in the form of ferrite rings surrounding the first beam element 4. The first ferrite ring 8', which is placed closer to the supply transformer 2 than a second ferrite ring 8", defines a first beam element portion 4'. The first beam element portion is located between the supply transformer 2 and the first ferrite ring 8'.

The second ferrite ring 8" defines a second beam element portion 4", which is located between the first ferrite ring 8' and the second ferrite ring 8", from a third beam element portion 4'". The third beam element portion 4'" projects outwardly from the second ferrite ring 8".

The second beam element 6 is divided in a corresponding manner into a fourth, a fifth and a sixth beam element portion 6', 6" and 6'" by means of a third and a fourth ferrite ring 10' and 10".

When the antenna is fed a voltage through the supply line 12 at a relatively low frequency, the full length of the first beam element 4 and the second beam element 6 radiate without the ferrite rings 8', 8", 10', 10" affecting the radiation to any substantial degree. Upon increasing frequency, the second ferrite ring 8" and the fourth ferrite ring 10" limit the power supplied to the third beam element portion 4'" and the sixth beam element portion 6'", respectively, whereby the effective electrical length of the antenna 1 is reduced and thereby adapted to the higher frequency.

Upon further increase in the frequency, the first ferrite ring 8' and the third ferrite ring 10' limit the power supplied to the second beam element portion 4" and the fourth beam element portion 6", respectively, whereby the electrical length of the antenna 1 is further shortened.

The selection of ferrite ring may be made on the basis of known principles, for example by employing a computer program aimed at calculating the electromagnetic properties of bodies.

Figure 2:
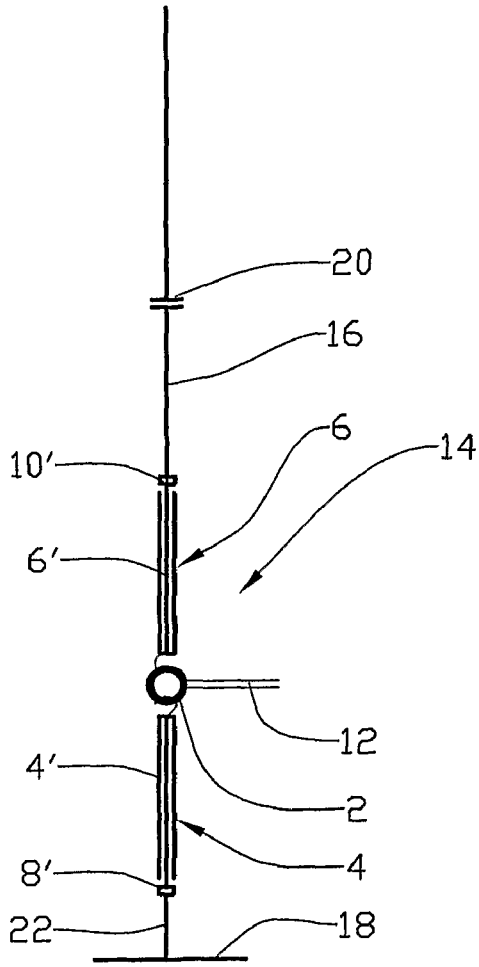
FIG. 2 schematically shows a centre-fed rod antenna provided with a ground-plane-dependent end-fed antenna element.

An alternative embodiment, see FIG. 2, shows a hybrid antenna 14 comprising a third beam element 16 and a ground-plane 18 in addition to the supply transformer 2, the first beam element 4 and the second beam element 6. The third beam element 16 may be connected to the supply transformer 2 or to the second beam element 6. The ground-plane may be connected in a corresponding manner to the supply transformer 2 or to the first beam element 4.

In the hybrid antenna 14 according to the shown exemplary embodiment, the first beam element is formed from the first beam element portion 4' with the first ferrite ring 8' connected thereto, whereas the second beam element is formed from the fourth beam element portion 6' with the third ferrite ring 10' connected thereto.

The third beam element 16 may be divided in a manner known per se by means of a capacitor 20.

Figure 3:
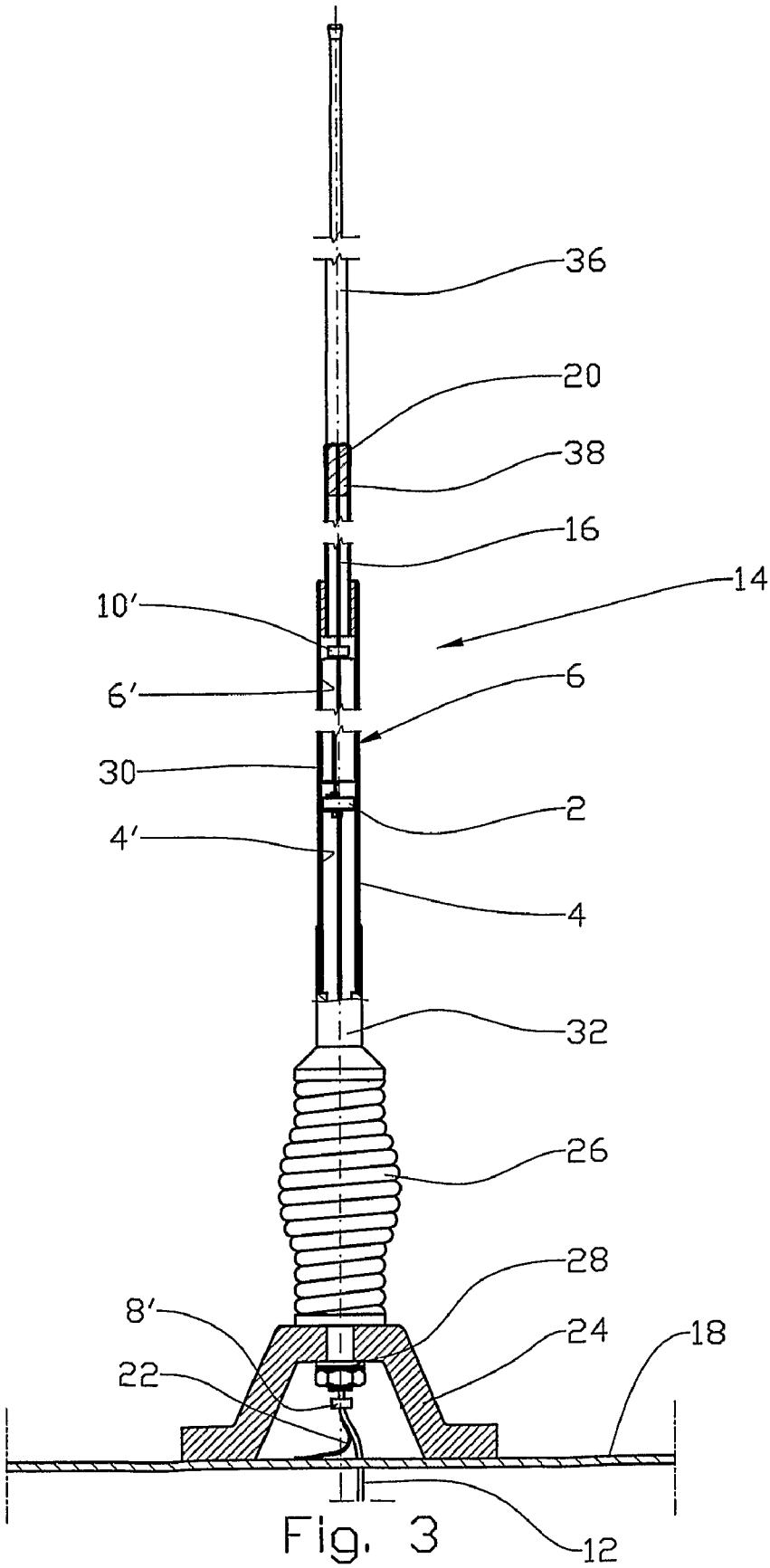
FIG. 3 shows a section of an antenna according to FIG. 2.

The third beam element 16 extends through the third ferrite ring 10', and a connecting line 22 to the ground-plane 18 extends through the first ferrite ring 8'. In FIG. 3 this connecting line 22 is formed from the shield of the supply line 12, the shield being connected to the first beam element portion 4'.

When the hybrid antenna 14 is fed a voltage at a relatively low frequency via the supply line 12, the third beam element 16 in cooperation with the ground-plane 18 radiates energy without the ferrite rings 8' and 10' affecting the radiation to any significant degree. Upon increasing frequency, the first ferrite ring 8' and the third ferrite ring 10' limit the power supplied to the third beam element 16 and the ground-plane 18, respectively.

Figure 6:
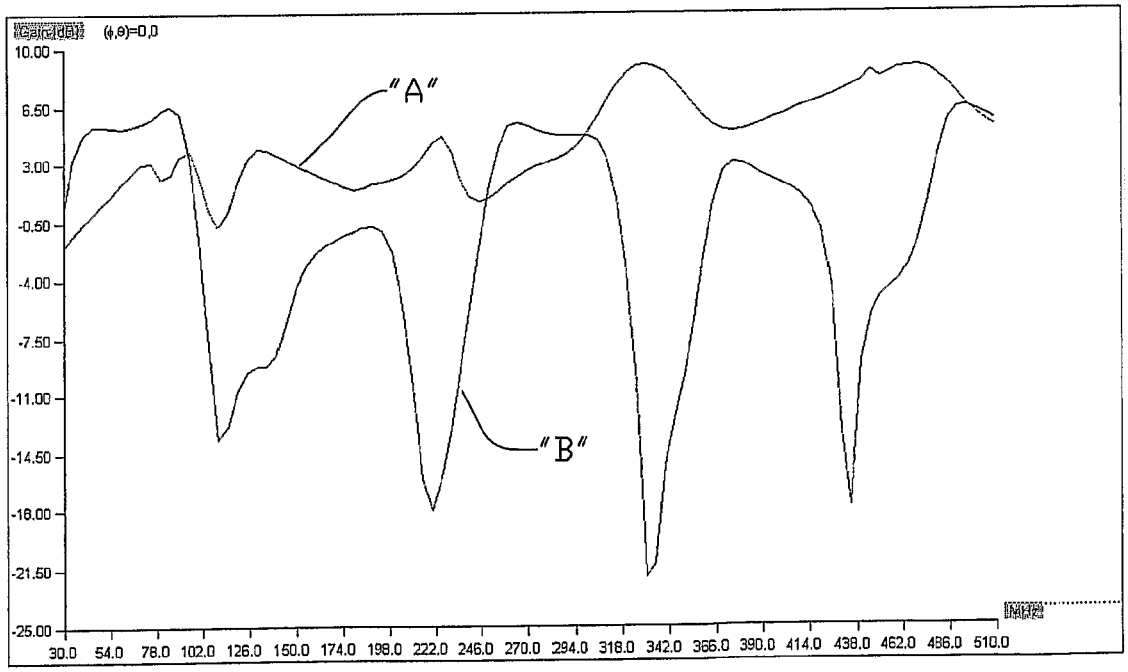
FIG. 6 shows a graph of gain in dB across the frequency range 30-512 MHz for the antenna of FIG. 3 as compared to a rod antenna according to prior art.

Thereby the hybrid antenna 14 is changed from radiating like an end-fed ground-plane-dependent antenna into radiating like a centre-fed antenna. FIG. 6 shows a graph across the frequency range 30-512 MHz, in which gain is plotted in dB for the antenna shown. Curve "A", which shows values for the hybrid antenna 14, is compared to a ground-plane-dependent rod antenna according to prior art. The latter is shown in curve "B". As viewed across the frequency range in question, the figure clearly shows, see curve "A", that the antenna according to the invention exhibits a substantially smoother gain curve than that of the antenna according to prior art, see curve "B".

Figure 4:
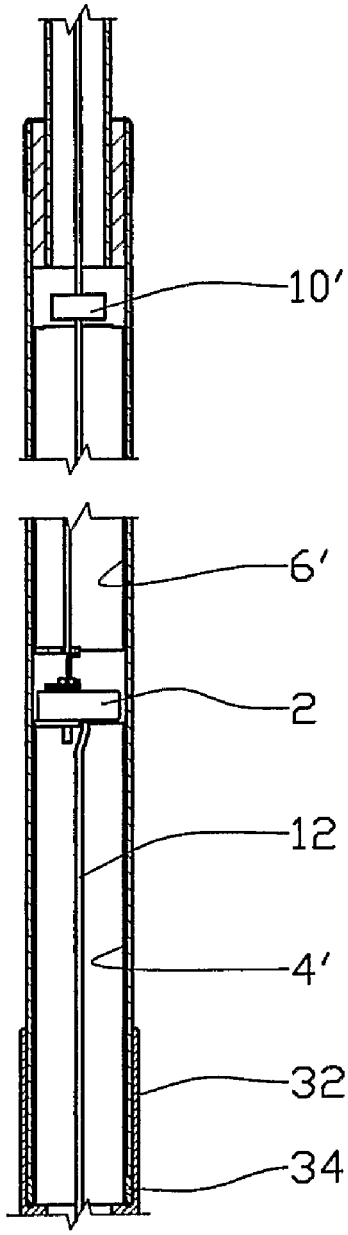
FIG. 4 shows, on a larger scale, a cutout section of the antenna of FIG. 3.

FIGS. 3 and 4 show a practical embodiment of the antenna of FIG. 2. In order to show the electrical components better, some necessary mechanical attachments and similar are not shown. These, however, will be familiar to a skilled person.

The hybrid antenna 14 is provided with a base 24 connected to the ground-plane 18 by means of bolt connections, not shown.

A spring 26 made from an electrically conductive material is connected to the base 24 by means of a screw and nut connection 28, and to a composite pipe 30 by means of an electrically conductive attachment 32.

The composite pipe 30 encloses the supply transformer 2, the beam elements 4, 6, which are formed from brass pipes, the third ferrite ring 10' and partly also the third beam element 16. The composite pipe 30 forms part of the mechanical, supporting structure of the hybrid antenna 14.

A contact ring 34 connects the first beam element portion 4' to the attachment 32 and thereby to the spring 26. Strictly speaking, the attachment 32 and spring 26 thus form part of the first beam element 4' in this embodiment, insofar as the first ferrite ring 6' surrounds the connecting line 22 and is located in the base 24.

The upper portion 36 of the third beam element 16 is attached to the hybrid antenna 14 by means of a releasable threaded connection 38.

The supply line 12 extends via through bores, not shown, via the screw and nut connection 28 and the attachment 32 and upwards to the supply transformer 2.

Figure 5:
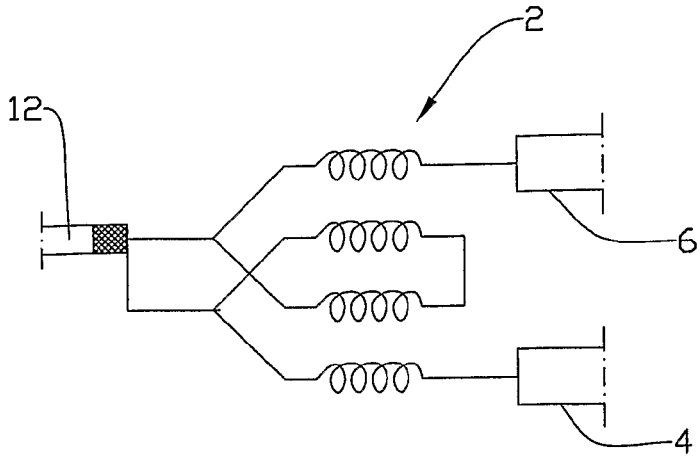
FIG. 5 shows a circuit diagram for the supply transformer belonging to the antenna of FIG. 3.

FIG. 5 shows a circuit diagram for the supply transformer 2.

If desirable, also the third beam element 16 may be provided with a ferrite material, not shown, and in the same manner as the first beam element 4 and the second element 6.

The invention claimed is:

1. A device of a rod antenna comprising a supply transformer and first and second beam elements, characterized in that, in addition to being connected to the first and second beam elements, the supply transformer is connected to a third beam element and a ground-plane, wherein a connecting line between the supply transformer and the ground-plane is provided with a ferrite material.

2. The device in accordance with claim 1, characterized in that the third beam element is provided with a ferrite material.

3. The device in accordance with claim 2, characterized in that the ferrite material forms a ring.

4. The device in accordance with claim 1, characterized in that at least one of the first and second beam elements forms a part of the third beam element.

5. The device in accordance with claim 1, characterized in that the third beam element is divided by means of a capacitor.

6. The device in accordance with claim 1, characterized in that the ferrite material forms a ring.

* * * * *